United States Patent [19]

LeBlanc et al.

[11] Patent Number: 4,970,983

[45] Date of Patent: Nov. 20, 1990

[54] MULTITONE HORN

[75] Inventors: Kenneth J. LeBlanc, Gloucester; Robert J. Dowding, Quincy; William Anastos, Belmont; Max Scholz, Newburyport, all of Mass.

[73] Assignee: Rule Industries, Inc., Gloucester, Mass.

[21] Appl. No.: 250,318

[22] Filed: Sep. 28, 1988

[51] Int. Cl.[5] ..... G10K 9/04

[52] U.S. Cl. ..... 116/142 F P; 116/137 R; 116/140; 116/142 R; 446/206

[58] Field of Search ..... 116/112, 137 R, 140, 116/142 FP, 142 R, DIG. 44; 222/402.1, 402.13, 402.15; 446/206, 208, 209

[56] References Cited

U.S. PATENT DOCUMENTS

| | | | |
|---|---|---|---|
| Re. 24,730 | 10/1959 | Reeves | 116/112 |
| D. 230,090 | 1/1974 | Pappas | D72/1 C |
| D. 245,488 | 8/1977 | Pappas et al. | D10/106 |
| 992,487 | 5/1911 | Ellison | 116/137 R |
| 1,043,703 | 11/1912 | Hutchison | 116/142 R |
| 1,627,467 | 5/1927 | Sparlin | 116/139 |
| 1,947,336 | 2/1934 | Eaton | 116/142 |
| 2,142,221 | 8/1936 | Stevens et al. | 116/142 |
| 2,155,232 | 6/1936 | Kelley | 116/142 |
| 2,229,322 | 1/1941 | Berlin | 446/206 |
| 2,391,669 | 12/1945 | Baker | 116/140 |
| 2,860,820 | 11/1958 | Falligant | 222/402.13 X |
| 3,000,344 | 9/1961 | Ferrell | 116/142 R |
| 3,117,552 | 1/1964 | Swanson | 116/142 |
| 3,273,610 | 9/1966 | Frost | 222/402.13 X |
| 3,477,405 | 11/1969 | Jensen | 116/137 |
| 3,670,689 | 6/1972 | Pappas | 116/112 |
| 3,670,690 | 6/1972 | Swanson | 116/112 |
| 3,732,843 | 5/1973 | Pappas et al. | 116/86 |
| 3,757,731 | 9/1973 | Pappas et al. | 116/112 |
| 3,780,694 | 12/1973 | Wilbur | 116/112 |
| 4,007,703 | 2/1977 | Frigo | 116/142 |
| 4,102,297 | 7/1978 | Reilly | 116/142 |
| 4,121,533 | 10/1978 | Pappas et al. | 116/5 |
| 4,170,189 | 10/1979 | Pappas et al. | 116/106 |
| 4,227,482 | 10/1980 | Scheindel | 116/142 FP |
| 4,401,049 | 8/1983 | Bevillard | 116/142 FP |
| 4,513,874 | 4/1985 | Mulawski | 220/89 |

FOREIGN PATENT DOCUMENTS

| | | | |
|---|---|---|---|
| 19442 | 10/1914 | France | 116/142 FP |

*Primary Examiner*—William A. Cuchlinski, Jr.
*Assistant Examiner*—W. Morris Worth
*Attorney, Agent, or Firm*—Fish & Richardson

[57] ABSTRACT

A horn for connection to a pressurized fluid container for sounding multiple tones has a horn body defining a sound chamber and at least one tone altering aperture extending through the horn body into the sound chamber, a sound producing mechanism located within the horn body adjacent the sound chamber, and a trigger assembly for actuating the pressurized fluid container for release of pressurized fluid to flow through the sound producing mechanism into the sound chamber to produce a sound. The horn, when the trigger mechanism is actuated, produces sound having a first tone when the tone altering aperture is unobstructed and a second tone when the aperture is obstructed.

6 Claims, 2 Drawing Sheets

MULTITONE HORN

The present invention relates to signal horns of the type mounted on containers holding a pressurized fluid, e.g., compressed or liquified gas, for use, e.g., as hand-held signal horns for boating and other similar applications.

Typically a plastic horn body is mounted atop a small disposable cannister of pressurized gas. The horn is actuated to release gas from the cannister to pass through a sound chamber within the horn body, e.g. to vibrate a metal diaphragm to create a blast of sound.

SUMMARY OF THE INVENTION

According to the invention, a horn for connection to a pressurized fluid container for sounding multiple tones comprises a horn body defining a sound chamber and at least one tone altering aperture extending through the horn body into the sound chamber, a sound producing mechanism located within the horn body adjacent the sound chamber, and a trigger assembly for actuating the pressurized fluid container for release of pressurized fluid to flow through the sound producing mechanism into the sound chamber to produce a sound. The horn is adapted, when the trigger mechanism is actuated, to produce sound having a first tone when said tone altering aperture is unobstructed and a second tone when the aperture is obstructed.

Preferred embodiments of the invention may include one or more of the following features. The horn further comprises an aperture-covering member adapted to move between at least a first position obstructing the aperture and a second position wherein the aperture is unobstructed. Preferably the aperture-covering member is a slide mechanism slideably mounted to the horn body for movement between the first and second positions. More preferably, the slide mechanism and horn body define corresponding notch and projecting boss formations that interengage to restrain the slide mechanism from inadvertent movement. The trigger mechanism comprises the aperture-covering member. The horn further comprises a connection mechanism constructed for attachment of the horn upon the pressurized fluid container, comprising a connector body, the connector body defining threads adapted to receive corresponding threads of the horn body, and flexible downpending arms terminating in hook means for engaging a lip of the container. The horn further comprises a plurality of tone altering apertures, and the aperture-covering member is adapted to move among a plurality of positions thereby varying the number of tone altering apertures that are obstructed. The horn further includes a pressurized fluid container.

According to another aspect of the invention, a trigger mechanism for a horn adapted for connection to a pressurized fluid container comprises a valve actuating element defining an arcuate surface, a trigger element defining a ramp surface disposed to engage upon the arcuate surface, and a fluid-flow actuator, wherein as the trigger is actuated, the ramp portion engages upon the arcuate surface to cause actuation of the actuator for flow of fluid, e.g., gas, from the container.

Preferred embodiments of this aspect of the invention may include one or more of the following features. The arcuate surface is substantially dome shaped. The valve actuating element is contiguous to the ramp portion.

Thus there is provided a horn for connection to a pressurized fluid container of the type well known, e.g., for use as a signal horn on small boats that is capable of sounding a multiplicity of different tones by means of a tone altering aperture defined in the wall of the horn body, to be covered or uncovered as desired for producing the multiple tones. In preferred embodiments, the aperture may be covered by either a slide or by the trigger mechanism. It has further been discovered that smooth trigger actuation may be accomplished by providing a trigger mechanism with a ramped trigger surface that engages upon an arcuate actuator surface.

DESCRIPTION OF THE PREFERRED EMBODIMENT

We first briefly describe the drawings.

Figure 1A:
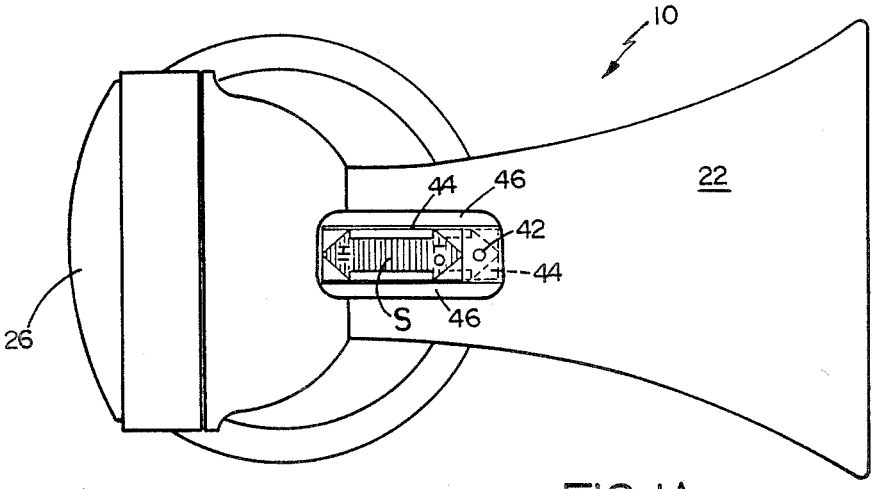
Figure 1:
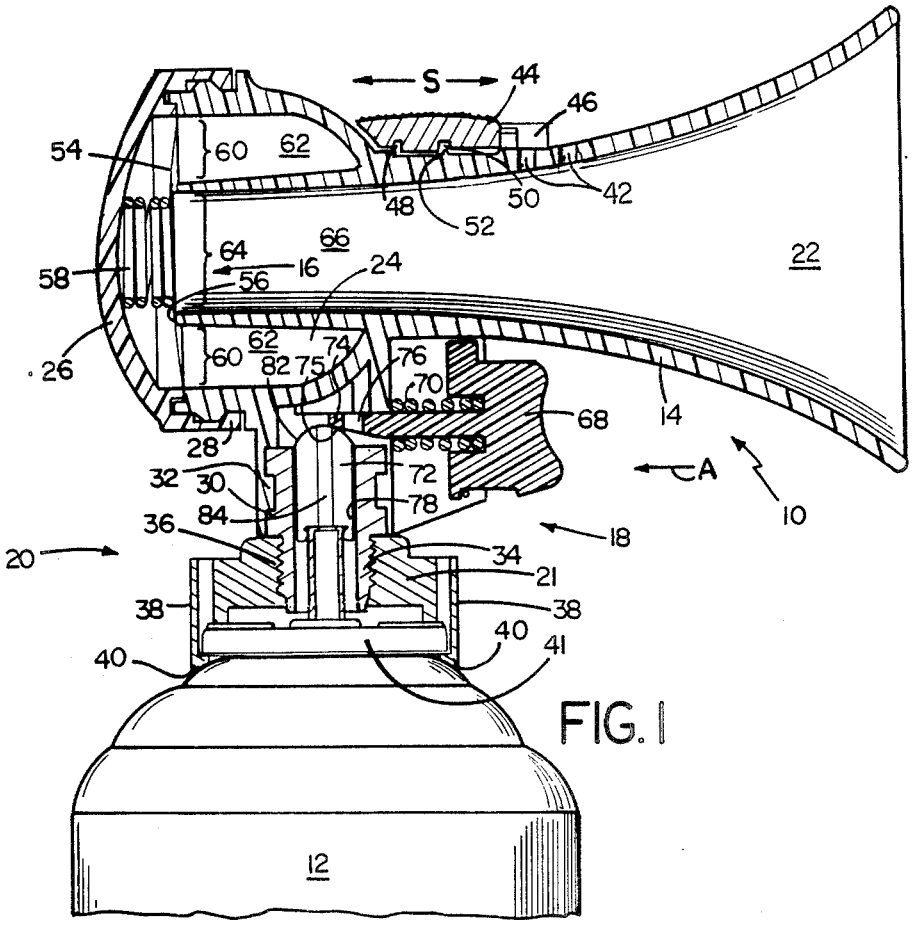
Figure 2:
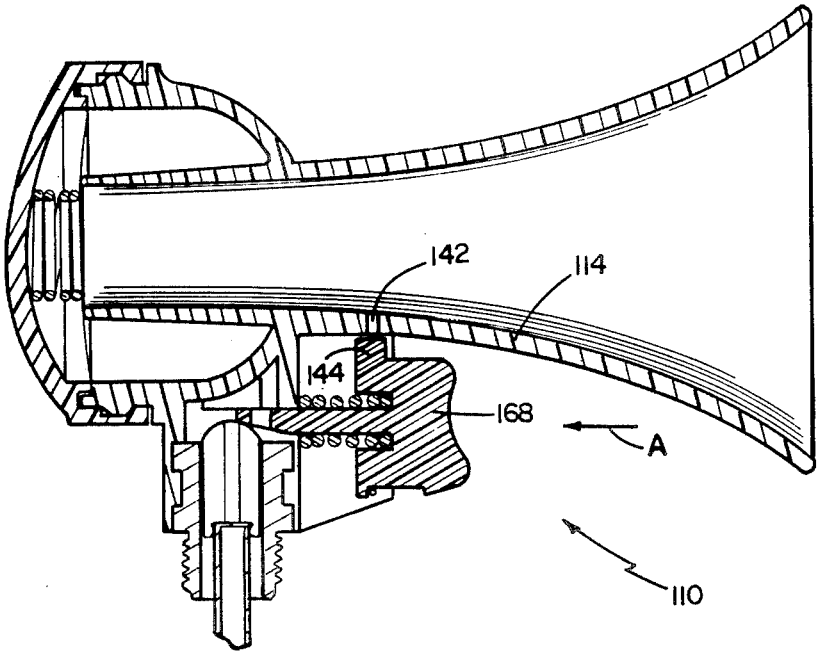

FIG. 1 is a multitone horn in accordance with the present invention;

FIG. 1*a* is a top view of the horn showing the slide mechanism for varying horn tone; and FIG. 2 is an alternate embodiment of a multitone horn in accordance with the present invention.

STRUCTURE

Referring to FIG. 1, horn 10 for use in combination with a cannister of pressurized fluid 12, e.g. FREON 12 ® (difluorodichloromethane), of the type known for use with signal horns includes horn body 14, sound producing assembly 16 and horn actuating assembly 18. The horn 10 is securely mounted to the pressurized fluid cannister by connection mechanism 20, described more fully below.

Horn body 14, of standard construction, is formed of high density, injection molded polyethylene and includes flared bell portion 22, fluid directing conduit portion 24, and back 26, also of high density injection molded polyethylene, fixedly attached, e.g. by snap fit at 28, onto horn body 14. Threaded connector element 30, e.g., a metal insert, extends from the base 32 of the horn body 14 and defines a male threaded portion 34 sized for threaded engagement with the corresponding female threaded 36 portion of the connector body 21. The connector body 21 and attached horn are further attached to the cannister by means of flexible, downpending arms 38 terminating in hooks 40 disposed to engage beneath the rim 41 of the cannister.

According to the invention, horn body 14 further defines tone altering aperture 42, e.g. disposed through the upper portion of the horn flared bell portion 22. A slide mechanism 44 is disposed for sliding movement (arrows S) between overhanging rails 46 which hold the slide in place (FIG. 1*a*). Slide mechanism 44 defines recesses 48, 50 which mate alternately with projecting boss 52 defined by the outer surface of the horn body 14, also described more fully below, to restrict inadvertent movement of the slide between positions.

Sound producing assembly 16 includes 1.6 inch diameter, 0.003 inch thick diaphragm 54 formed of stainless steel. The edge of diaphragm 54 is clamped between the horn body 14 and back 26, and bows concavely, e.g. by about 0.012 inch at its center, toward the horn back 26 by engagement of the diaphragm upon horn body rim 56. Spring 58 is positioned between horn back 26 and diaphragm 54 and urges the diaphragm into contact with the rim. The outer annular portion 60 of the surface of the diaphragm 54 defines, with fluid directing conduit portion 24 of the horn body, a fluid pressure chamber 62, while the center surface portion 64 of the diaphragm defines a surface of the sound generating chamber 66.

Actuating assembly 18 includes trigger 68, trigger spring 70, and valve actuating element 72. Trigger 62 includes ramp portion 74 having a ramp surface 75, sloped, e.g., between about 15° to 18°. Ramp portion 74 defines an aperture 76 for flow of fluid from the cannister. Valve actuating element 72 is disposed in fluid tight relationship within an aperture 78 defined by connector element 34, and rests upon outlet tube 80 of canister 12. Actuating element has an arcuate surface 82, e.g. a dome, at its upper end, engaged upon the ramp surface 75. The trigger 68 and ramp portion 74, and the actuating element 72 are formed of injection molded 30% glass filled nylon.

OPERATION

Referring to FIG. 1, actuation of trigger 68 (arrow A) causes the ramp surface 75 to slide along the domed surface 82 of actuating element 72, thereby forcing element 72 and cannister outlet tube 80 (upon which it is mounted) downward to release pressurized fluid to flow from cannister 12. The pressurized fluid flows through the central conduit 84 of actuating element 72, through aperture 76 of trigger ramp portion 74 and, via the fluid directing conduit portion 24 of the horn body 14, into the fluid pressure chamber 62. As pressure builds in chamber 62, the elasticity of the bowed stainless steel diaphragm 54 and the force of spring 58 are overcome, lifting the diaphragm 54 from rim 56 for escape of gas into sound chamber 66. In this manner, the diaphragm 54 is caused to vibrate to produce a sound which emanates from the flared bell portion 22 of the horn.

According to the invention, there is provided a tone altering aperture 42 and a slide 44 is positioned relative to the aperture in a manner to either leave the aperture unobstructed (FIG. 1 and solid line in FIG. 1*a*) or to obstruct it (dashed line in FIG. 1*a*). As trigger 68 is actuated with tone altering aperture 42 obstructed, a first (lower) tonal sound is produced. When tone altering aperture 42 is unobstructed, a second (higher) tonal sound is produced. The position of slide 44 may be altered (arrows S) during trigger actuation to vary the tone as it is sounded. Recesses 48, 50 and boss 52 interengage (boss 52 with recess 50 when aperture 42 is unobstructed for sounding a first tone; boss 52 with recess 48 when aperture 42 is obstructed for sounding a second tone) to resist inadvertent movement of slide 44 between its obstructing position and its unobstructing position.

OTHER EMBODIMENTS

Referring to FIG. 2, tone altering aperture 142 of horn 110 may be located, e.g., through the lower portion of the horn body 114, and the trigger 168 may have an upstanding aperture-obstructing portion 144. As the trigger mechanism 168 is pulled (arrow A), the tone altering aperture 142 is either obstructed (as shown) or, as the trigger is pulled further, unobstructed, as desired. Means (e.g. recesses and bosses as described above) may also be provided to indicate to the user the position of the trigger relative to the aperture, and to restrict inadvertent movement of the trigger between positions.

Additionally, horn body 14 may define a plurality of tone altering apertures. Thus, the tone produced may be adjusted by varying the combination of tone producing apertures which are obstructed by an aperture-covering mechanism.

What is claimed is:

1. A horn for connection to a pressurized fluid container for sounding multiple tones comprising;

a horn body defining a sound chamber and at least one tone altering aperture extending through said horn body into said sound chamber, a sound producing mechanism located within said horn body adjacent said sound chamber, means for actuating the pressurized fluid container for release of pressurized fluid to flow through said sound producing mechanism into said sound chamber to produce a sound, said horn adapted, when said means for actuating is actuated, to produce sound having a first tone when said tone altering aperture is unobstructed and a second tone when said aperture is obstructed, and an aperture-covering member, said aperture covering member adapted to move between at least a first position obstructing said aperture and a second position wherein said aperture is unobstructed, said aperture-covering member comprising a slide mechanism slideably mounted to said horn body for movement between said first and second positions.

2. A horn for connection to a pressurized fluid container for sounding multiple tones comprising:

a horn body defining a sound chamber and at least one tone altering aperture extending through said horn body into said sound chamber, a sound producing mechanism located within said horn body adjacent said sound chamber, means for actuating the pressurized fluid container for release of pressurized fluid to flow through said sound producing mechanism into said sound chamber to produce a sound, and an aperture covering member, comprising a slide mechanism slidably mounted to said horn body for movement between first and second positions, said slide mechanism adapted to move between at least a first position obstructing said aperture and a second position wherein said aperture is unobstructed, said horn adapted, when said means for actuating is actuated, to produce sound having a first tone when said tone altering aperture is unobstructed and a second tone when said aperture is obstructed, wherein said slide mechanism and horn body define corresponding notch and projecting boss formations that interengage to restrain said slide mechanism from inadvertent movement.

3. A horn for connection to a pressurized fluid container for sounding multiple tones comprising:

a horn body defining a sound chamber and at least one tone altering aperture extending through said horn body into said sound chamber, a sound producing mechanism located within said horn body adjacent said sound chamber, and means for actuating the pressurized fluid container for release of pressurized fluid to flow through said sound producing mechanism into said sound chamber to produce a sound, wherein said means for actuating comprises a trigger mechanism and said trigger mechanism comprises an aperture-covering member, said aperture covering member adapted to move between at least a first position obstructing said aperture and a second position wherein said aperture is unobstructed, said horn adapted, when said means for actuating is actuated, to produce sound having a first tone when said tone altering aperture is unobstructed and a second tone when said aperture is obstructed.

4. The horn of claim 1 further comprising a connection mechanism constructed for attachment of said horn upon the pressurized fluid container, comprising a connector body, said connector body defining threads adapted to receive corresponding threads of said horn body, and flexible downpending arms terminating in hook means for engaging a lip of the container.

5. The horn of claim 1 further comprising a plurality of tone altering apertures, said aperture-covering member being adapted to move among a plurality of positions thereby varying the number of said plurality of tone altering apertures being obstructed.

6. The horn of claim 1 in combination with a pressurized fluid container.

* * * * *